US007146975B1

(12) United States Patent
MacPherson

(10) Patent No.: US 7,146,975 B1
(45) Date of Patent: Dec. 12, 2006

(54) GAS FIRE LOG SYSTEM WITH COLLAPSING LOGS

(75) Inventor: John A. MacPherson, Front Royal, VA (US)

(73) Assignee: Desa IP, LLC, Miami, FL (US)

( * ) Notice: Subject to any disclaimer, the term of this patent is extended or adjusted under 35 U.S.C. 154(b) by 217 days.

(21) Appl. No.: 10/978,189

(22) Filed: Oct. 29, 2004

Related U.S. Application Data

(60) Provisional application No. 60/516,534, filed on Oct. 31, 2003.

(51) Int. Cl.
*F24B 1/18* (2006.01)

(52) U.S. Cl. ..... 126/502; 126/512; 126/541

(58) Field of Classification Search ..... 126/500, 126/502, 512, 541; 431/125; 40/428; 44/535
See application file for complete search history.

(56) References Cited

U.S. PATENT DOCUMENTS 3,805,762 A * 4/1974 Nelson ..... 126/506
5,067,476 A * 11/1991 Rhodes, Jr. ..... 126/540
5,271,888 A * 12/1993 Sinsley ..... 264/87
5,901,697 A * 5/1999 Oliver et al. ..... 126/92 AC
6,129,079 A * 10/2000 French et al. ..... 126/502
6,289,887 B1 * 9/2001 Oliver et al. ..... 126/92 AC

* cited by examiner

*Primary Examiner*—Ehud Gartenberg
*Assistant Examiner*—Sarah E. Sueretb
(74) *Attorney, Agent, or Firm*—John F. Salazar; Middleton Reutlinger

(57) ABSTRACT

A realistic gas fire log system providing log movement during use to enhance the realism of a fireplace system, comprising a ceramic fiber top, molded to look like charred embers or ash ported with one or more holes and recessed at the bottom to form a cavity, a steel pan sealed to the bottom of the ceramic fiber top, forming a chamber; a gas supply, gas control valve and a venturi fitted in an orifice through the pan, and including a log movement mechanism comprising an armature for pivotable attachment to one end of a fire log resting over a second fire log including two or more log sections connected by a spring and an activating mechanism, which armature causes the hinged log to collapse downwardly when activated and reposition into its original position when the fireplace is turned off. The log movement mechanism can be incorporated into existing gas fire log systems or made part of the original equipment of a gas fire log system.

24 Claims, 1 Drawing Sheet

GAS FIRE LOG SYSTEM WITH COLLAPSING LOGS

PRIOR U.S. APPLICATION

This Specification is based on U.S. Provisional Patent Application Ser. No. 60/516,534 filed on Oct. 31, 2003. The inventor claims the benefit of Title 35, Section 119 of the U.S. Code based on said provisional application.

COPYRIGHT NOTICE

A portion of the disclosure of this patent document contains material which is subject to copyright protection. The copyright owner has no objection to the facsimile reproduction by anyone of the patent document or the patent disclosure as it appears in the Patent and Trademark Office Patent file or records, but otherwise reserves all copyright rights whatsoever.

BACKGROUND OF THE INVENTION

1. Technical Field

The present invention relates to fireplace systems, and the like. More particularly, the present invention relates to a gas-fired, simulated log fireplace system that incorporates vacuum formed ceramic fiber to distribute the flame. This invention accommodates distribution of flame heat and presentation of visual realism through collapsing log movement during fireplace operation.

2. Background

The ambiance and physical sensation associated with a natural flame such as those found in campfires and fireplaces are widely desired. But because of a number of economic and environmental issues including the pollution and physical mess of wood burning, the use of wood-burning appliances and open campfires has been severely restricted in recent years. Fireplaces have existed for several centuries. The original purpose of a fireplace was to provide heat for a living space. In modern times, in addition to heat, fireplaces are valued for the soothing ambiance they provide, derived from their appearance and the sound generated by burning wood. There have been a number of attempts to produce a realistic appearing system of synthetic logs, burning wood pellets, natural gas, propane, LPG, or butane that would duplicate the ambiance of wood burning without the liabilities. Several systems have reached the marketplace and have enjoyed some commercial success. However, none of these systems have achieved the appearance, ambiance, and functional realism of real wood fires.

In the face of the these economic and environmental factors, the traditional gas burning fireplaces are now commonly used in lieu of natural wood burning fireplaces. They are much easier to start, require almost no cleaning, and can be constructed so as to operate in an environmentally sound manner. In the past few years, due to added cleanliness, improved heating efficiency and environmental restrictions on air pollution, gas fireplaces have grown in popularity. Today, nearly all fireplaces sold are gas, not wood burning. The term gas fireplace as used herein is intended to encompass both natural gas as well as propane fueled units.

Conventional fireplace and gas log set designs consist of steel pans and/or tubes to distribute flame, are static and make no sound. Various configurations and designs of simulated gas-burning fireplace logs are in use and known in the prior art. Typically, the logs system has been made so that a natural gas inlet line leads to a gas manifold located within the firebox itself. The inlet line passes through the firebox containment bricks or metal liners and will normally include at least one main flow valve and a valved tap for a standing pilot. These valves and any associated electronic controls are placed either in the containment material or within the firebox itself. To complete the unit, a number of simulated, ceramic logs are placed atop the manifold. When the device is lit, flames from the manifold pass upwardly through the logs, thereby simulating the typical flame pattern of a traditional wood-burning fireplace. There is, however, a long-felt need for an improved burner and display apparatus for gas fireplaces and similar devices. In particular, there is a need for log movement to enhance the realism of the fireplace system.

SUMMARY OF THE INVENTION

The present invention addresses these and other problems in the prior art, by providing a realistic gas fire log system that provides log movement during the utilization of the fireplace.

A general object of this invention is to provide a gas fire log system with visual realism through collapsing logs. Owners of gas fireplaces express a desire for enhanced ambiance such as log movement, as would be experienced during the operation of burning wood. Insofar as is known, no gas system addresses this problem. There is a need for a gas fireplace system, which produces the visual realism of moving or collapsing logs.

Further novel features and other objects of the present invention will become apparent from the following detailed description, discussion and the appended claims, taken in conjunction with the drawings.

BRIEF DESCRIPTION OF THE FIGURES

The accompanying drawing, which is incorporated in and constitutes a part of this specification, illustrates embodiments of the invention, and, together with the general description of the invention given above, and the detailed description of the embodiments given below, serves to explain the principles of the present invention.

DETAILED DESCRIPTION OF THE PREFERRED EMBODIMENT

Figure 1:
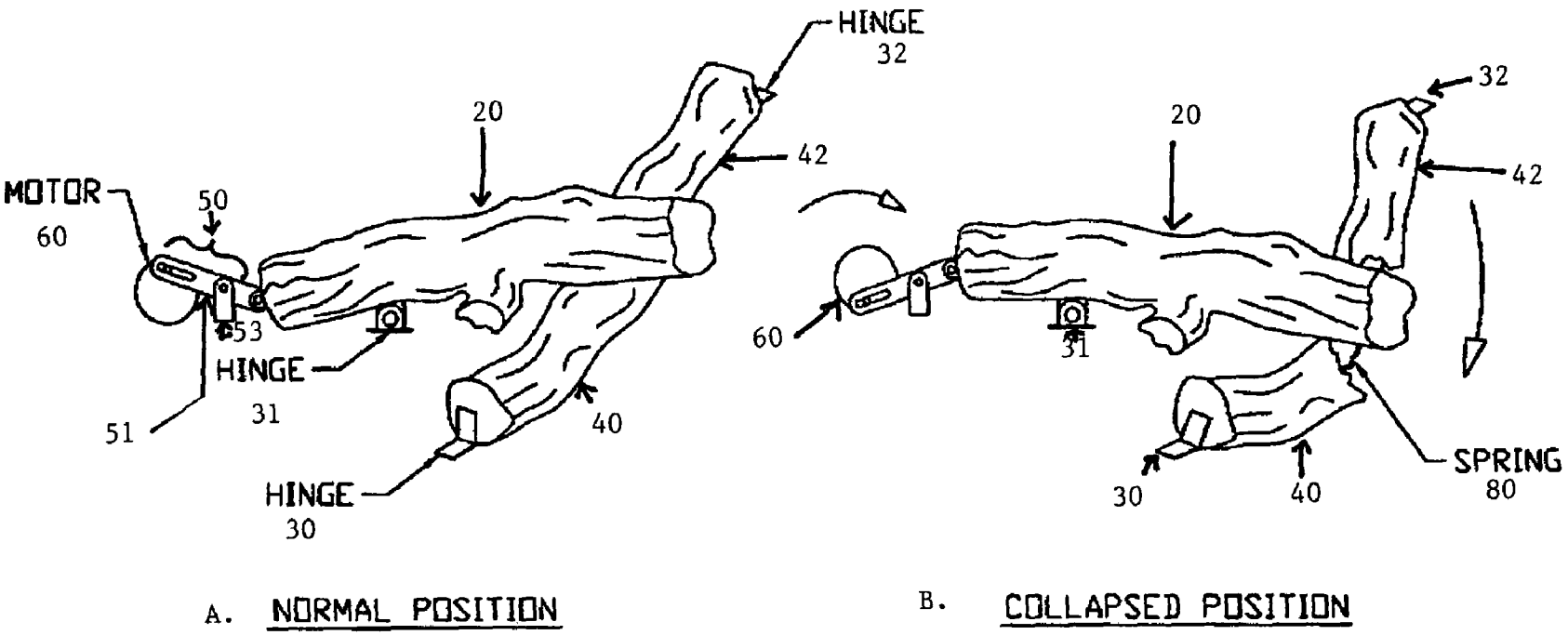
FIG. 1 is a front elevation view of a fireplace system embodying the collapsing log mechanism, showing the normal position (A) and collapsed position (B).

In the following description, like reference characters designate like or corresponding parts throughout the several views. Also, in the following description, it is to be understood that terms such as front, back, inside, outside, and the like are words of convenience and are not to be construed as limiting terms. Terminology used in this patent is not meant to be limiting insofar as devices described herein, or portions thereof, may be attached or utilized in other orientations. Referring in more detail to the drawings, the invention will now be described.

Generally, the present invention comprises a ceramic fiber top molded to look like charred embers and ash. The top can be molded to represent any shape of ash, embers or log pieces. The top is ported with any number of holes to allow gas to flow through. The ceramic top has a recess in the bottom to form a cavity. The top is then sealed to a steel plate or pan to form a gas chamber. This chamber is then fitted with a venturi and connected to a gas supply regulated by a valve and orifice. When placed in operation, the realistic gas fire log system has the appearance of glowing ash and embers with no visible metal burner parts. The system is fully adjustable and a remote control device can be used to allow flame setting to vary from high to low. Further, the system radiates more heat than refractory concrete logs.

Referring to the movement mechanism, the collapsing log falls into the fire at a predetermined time preferably by way of thermocouple and/or bimetallic spring temperature sensing which activates and deactivates the activating mechanism. The log is attached to an armature that allows it to be dropped into the fire and then repositioned into its original location when the fire is turned off. In one embodiment, the collapsing log comprises two logs, three hinges, a spring and a motor. Further, this invention operates without any electrical hook-up requirements although it can operate with an electric motor supplied with electric power via a battery or other electric supply. The hinges utilized can be of various types, pin-type axially rotating hinges, leaf and pin-type hinges, or other pivotable linkage and the references to "hinge" herein are intended to include all such types of connection means.

Referring to FIG. 1, which depicts the log movement mechanism of the present invention in a preferred embodiment, showing the normal or uncollapsed position A and the collapsed position B. A first fire log 10, having a first end, a second end, a central portion and a bottom facing surface that is pivotably connected at a point between said first end and said central portion to a non-moving portion of the fireplace. The pivotable connection can be accomplished by a hinge 31, such as a pin-type support hinge as shown, allowing the log to rotate around the axis of the connection point. The activation mechanism, in a preferred embodiment, comprises a motorized, preferably temperature sensing, armature 50 which is pivotably connected to the first end of said first log 10. The motorized armature 50 comprises a motor 60, which, as shown in FIG. 1, is preferably of the type having a rotational wheel and a connecting rod 50 pivotably connected at one end to said rotational wheel and pivotably connected at the opposite end to said first end of said first log 20.

Connecting rod 51 is also preferably pivotably connected to a pin-type hinge support 53 at a point between its central portion and the end connected to said first log to create a lever effect, such that when the motor 60 is activated, it causes the connecting rod 51 to pivot about the axis of the pin-type hinge support 53, causing the first end of said first log 20 to rise, which in turn causes the second end of said first log to drop, pushing down on the second log comprising log sections 40 and 42 in the area where log sections 40 and 42 are connected by spring 80. The second log sections 40 and 42 are preferably pivotably connected at their outer ends to a non-moving portion of the fireplace via pin-type leaf hinges 30 and 32 as shown. The second fire log, comprising log sections 40 and 42, is positioned under first log 20 near the end of the first log opposite to the end connected to the activating mechanism 60. When the activating mechanism is deactivated, such as when the fireplace is turned off and the temperature drops, the second log returns to its uncollapsed original position via force of spring 80, which results in the first log 20 also being returned to its original position.

The present invention is also a method for enhancing the realism of a gas fire log fireplace by providing a collapsing fire log feature, comprising the steps of: including a first fire log having a first end, a second end, a central portion and a bottom facing surface pivotably connected at a point between said first end and said central portion to a non-moving portion of said fireplace; connecting an activating mechanism to said first end of said first fire log; positioning a second fire log, comprising two or more log sections having adjacent ends connected to each other by a spring, underneath said first fire log near said first fire log's second end; and activating said activating mechanism to cause said first fire log to push said second fire log downward to a collapsed position. Additional steps include deactivating the activating mechanism to cause said first fire log and said second fire log to return to an uncollapsed position, and pivotably connecting the outer ends of the second log to a non-moving portion of the fireplace system.

The log movement mechanism can be incorporated into existing gas fire log systems or made part of the original equipment of a gas fire log system.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative and other embodiments may be selected without departing from the spirit and scope of the present invention.

What is claimed is:

1. A gas fire log fireplace system with collapsing logs, comprising:

a first fire log having a first end, a second end, a central portion and a downward facing surface, said first fire log being pivotably connected at a point in said log's downward-facing surface between said first end and said central portion to a non-moving portion of said fireplace;

an activating mechanism connected to said first end of said first fire log;

a second fire log having two outer ends, each of said outer ends connected to a nonmoving portion of said fireplace system, and having a central portion positioned under said first fire log, such that it supports said first fire log near said second end of said first fire log, said second fire log comprising two or more log sections having adjacent ends connected by a spring;

such that when the temperature of the fireplace reaches a predetermined level, said activating mechanism causes said first fire log to push said second fire log downwardly in the area adjacent to where said second fire log's log sections are connected by said spring to a collapsed position, and when said activating mechanism is deactivated, causes said first and second fire logs return to an uncollapsed position.

2. The gas fire log fireplace system of claim 1, wherein said first and second fire logs are made of ceramic material.

3. The gas fire log fireplace system of claim 1, wherein said pivotable connection of said first fire log is in the form of a pin-type hinge.

4. The gas fire log fireplace system of claim 1, wherein at least one of said pivotable connections of second fire log is in the form of a pin-type hinge.

5. The gas fire log fire place system of claim 1, wherein said activating mechanism comprises a motor having a rotating wheel, a connecting rod linking at one end to said rotating wheel and at the other end to said first end of said first log, and pivotably connected to a non-moving portion of the fireplace system at a point between said connecting rod's central portion and the end connected to said first log, and activation means for said motor.

6. The gas fire log fireplace system of claim 5, wherein said activation means for said motor comprises a temperature sensing mechanism.

7. The gas fire log fireplace system of claim 6, wherein said temperature sensing mechanism comprises a thermocouple.

8. The gas fire log fireplace system of claim 6, wherein said temperature sensing mechanism comprises a bimetallic spring.

9. The gas fire log fireplace system of claim 5, wherein said motor is an electric powered motor and said activation means for said motor comprises electricity.

10. A collapsing fire log system for use in a gas fireplace, comprising:

a first fire log having a first end, a second end, a central portion and a bottom-facing surface pivotably connected at a point between said first end and said central portion to a non-moving portion of said fireplace;

an activating mechanism connected to said first end of said first fire log; and a second fire log having outer ends and a central portion disposed under said first fire log such that it supports said first fire log near said second end of said first fire log, said second fire log further comprising two or more log sections having adjacent ends connected by a spring, said outer ends of said second fire log being pivotably connected to a non-moving portion of said fireplace system;

such that when activated, said activating mechanism causes said first fire log to push said second fire log downwardly to a collapsed position, and when deactivated, causes said first and second fire logs to return to an uncollapsed position.

11. The collapsing fire log system of claim 10, wherein said first and second fire logs are made of ceramic material.

12. The collapsing fire log system of claim 10, wherein said first log is pivotably connected to a non-moving portion of said fireplace.

13. The collapsing fire log system of claim 12, wherein said pivotable connection is in the form of a pin-type hinge.

14. The collapsing fire log system claim 10, wherein at least one of said pivotable connections of the outer ends of said second log is in the form of a pin-type hinge.

15. The collapsing fire log system of claim 10, wherein said activation mechanism comprises a motorized armature.

16. The collapsing fire log system of claim 10, wherein said motorized armature comprises a motor having a rotating wheel, a connecting rod linking at one end to said rotating wheel and at the other end to said first and of said first log, and pivotably connected to a non-moving portion of the fireplace system at a point between said connecting rod's central portion and the end connected to said first log, and activation means for said motor.

17. The collapsing fire log system of claim 16, wherein said activation means for said motor comprises a temperature sensing mechanism.

18. The collapsing fire log system of claim 17, wherein said temperature sensing mechanism comprises a thermocouple.

19. The collapsing fire log system of claim 17, wherein said temperature sensing mechanism comprises a bimetallic spring temperature sensor.

20. The collapsing fire log system of claim 16, wherein said motor is an electric motor and said activation means for said motor is electricity.

21. A method for enhancing the realism of a gas fire log fireplace system by providing a collapsing fire log feature, comprising the steps of:

including a first fire log having a first end, a second end, a central portion and a bottom-facing surface pivotably connected at a point between said first end and said central portion to a non-moving portion of said fireplace;

connecting an activating mechanism to said first end of said first fire log;

positioning a second fire log, comprising two or more log sections having adjacent ends connected to each other by a spring, underneath said first fire log near said first fire log's second end; and activating said activating mechanism to cause said first fire log to push said second fire log downwardly to a collapsed position.

22. The method of claim 21, further comprising the step of deactivating said activating mechanism to cause said first fire log and said second fire log to return to an uncollapsed position.

23. The method of claim 21, further comprising the step of pivotably connecting the outer ends of said second fire log to a non-moving portion of said fireplace.

24. A collapsing fire log system for use in a gas fireplace, comprising:

a first fire log having a first end, a second end, a central portion and a bottom-facing surface pivotably connected at a point between said first end and said central portion to a non-moving portion of said fireplace;

an activating mechanism connected to said first end of said first fire log, comprising a motor having a rotating wheel, a connecting rod linking at one end to said rotating wheel and at the other end to said first and of said first log, and pivotably connected to a non-moving portion of the fireplace system at a point between said connecting rod's central portion and the end connected to said first log, and activation means for said motor; and a second fire log having outer ends and a central portion disposed under said first fire log such that it supports said first fire log near said second end of said first fire log, said second fire log further comprising two or more log sections having adjacent ends connected by a spring, said outer ends of said second fire log being pivotably connected to a non-moving portion of said fireplace system;

such that when activated, said activating mechanism causes said first fire log to push said second fire log downwardly to a collapsed position, and when deactivated, causes said first and second fire logs to return to an uncollapsed position.

* * * * *